US006551187B1

(12) United States Patent
Jaffe

(10) Patent No.: US 6,551,187 B1
(45) **Date of Patent: *Apr. 22, 2003**

(54) GAMING MACHINE WITH MOVING SYMBOLS ON SYMBOL ARRAY

(75) Inventor: Joel R. Jaffe, Evanston, IL (US)

(73) Assignee: WMS Gaming Inc., Chicago, IL (US)

( * ) Notice: Subject to any disclaimer, the term of this patent is extended or adjusted under 35 U.S.C. 154(b) by 206 days.

This patent is subject to a terminal disclaimer.

(21) Appl. No.: 09/679,207

(22) Filed: Oct. 4, 2000

Related U.S. Application Data

(63) Continuation-in-part of application No. 09/531,712, filed on Mar. 21, 2000.

(51) Int. Cl.[7] ..... A63F 9/24

(52) U.S. Cl. ..... 463/20; 463/25; 463/16

(58) Field of Search ..... 463/1, 10–13, 463/16, 18, 17, 19, 20, 22, 25–27, 30, 31

(56) References Cited

U.S. PATENT DOCUMENTS

| | | | | | |
|---|---|---|---|---|---|
| 5,720,662 | A | * | 2/1998 | Holmes et al. | 463/20 |
| 5,902,184 | A | | 5/1999 | Bennett | 463/13 |
| 6,056,642 | A | | 5/2000 | Bennett | 463/20 |
| 6,086,066 | A | * | 7/2000 | Takeuchi et al. | 463/20 |
| 6,089,977 | A | * | 7/2000 | Bennett | 463/13 |
| 6,120,378 | A | * | 9/2000 | Moody et al. | 463/13 |
| 6,159,098 | A | * | 12/2000 | Slomiany et al. | 463/20 |
| 6,190,254 | B1 | * | 2/2001 | Bennett | 463/13 |
| 6,190,255 | B1 | * | 2/2001 | Thomas et al. | 463/20 |
| 6,203,429 | B1 | * | 3/2001 | Demar et al. | 463/20 |
| 6,224,482 | B1 | * | 5/2001 | Bennett | 463/20 |
| 6,234,897 | B1 | * | 5/2001 | Frohm et al. | |
| 6,251,013 | B1 | | 6/2001 | Bennett | 463/13 |
| 6,261,177 | B1 | | 7/2001 | Bennett | 463/16 |
| 6,290,600 | B1 | * | 9/2001 | Glasson | 463/13 |
| 6,311,976 | B1 | * | 11/2001 | Yoseloff et al. | |
| 6,315,660 | B1 | * | 11/2001 | DeMar et al. | |
| 6,336,863 | B1 | * | 1/2002 | Baerlocher et al. | 463/20 |
| 6,358,147 | B1 | * | 3/2002 | Jaffe et al. | |
| 6,443,837 | B1 | * | 9/2002 | Jaffe et al. | |

FOREIGN PATENT DOCUMENTS

| | | |
|---|---|---|
| WO | WO 9732285 | 9/1997 |

OTHER PUBLICATIONS

Advertisement; "Penguin Pays," Aristocrat Incorporated, 1998.

* cited by examiner

*Primary Examiner*—Michael O'Neill
(74) *Attorney, Agent, or Firm*—Jenkens & Gilchrist

(57) ABSTRACT

A gaming machine is controlled by a processor in response to a wager and comprises a basic game and a bonus game. The basic game includes a plurality of symbols randomly placed in a viewable display area relative to at least one pay line. The basic game awards a basic game payout for any winning symbol combinations along the pay line, and includes a start-bonus outcome for triggering the bonus game. The bonus game includes a special indicator progressively moved to and stopped at one or more symbols in the viewable display area. For each symbol where the special indicator stops, the bonus game awards a bonus game payout for a winning scatter combination formed with that symbol regardless of whether the winning scatter combination is along the pay line. Thus, the symbol where the indicator stops pays as a scatter.

6 Claims, 9 Drawing Sheets

6/9

GAMING MACHINE WITH MOVING SYMBOLS ON SYMBOL ARRAY

REFERENCE TO RELATED APPLICATIONS

This application is a Continuation-in-part of prior application Ser. No. 09/531,712 filed on Mar. 21, 2000, now pending.

FIELD OF THE INVENTION

The present invention relates generally to gaming machines and, more particularly, to a gaming machine providing a game of chance in which a special symbol(s) moves around a symbol array shown on a visual display, the symbol array is evaluated for winning symbol combinations each time the special symbol(s) stops, and the game ends in response to the special symbol encountering a stop-bonus symbol that also moves around the symbol array.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. Shrewd operators consequently strive to employ the most entertaining and exciting machines available because such machines attract frequent play and hence increase profitability to the operator. Accordingly, in the competitive gaming machine industry, there is a continuing need for gaming machine manufacturers to produce new types of games, or enhancements to existing games, which will attract frequent play by enhancing the entertainment value and excitement associated with the game.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome of the basic game. Because the bonus game concept offers tremendous advantages in player appeal and excitement relative to other known games, and because such games are attractive to both players and operators, there is a continuing need to develop new features for bonus games to satisfy the demands of players and operators. Preferably, such new bonus game features will maintain, or even further enhance, the level of player excitement offered by bonus games heretofore known in the art. The present invention is directed to satisfying these needs.

SUMMARY OF THE INVENTION

A gaming machine is controlled by a processor in response to a wager and comprises a basic game and a bonus game. The basic game includes a plurality of symbols randomly placed in a viewable display area relative to at least one pay line. The basic game awards a basic game payout for any winning symbol combinations along the pay line, and includes a start-bonus outcome for triggering the bonus game.

In accordance with the present invention, the bonus game includes a special indicator progressively moved to and stopped at one or more symbols in the viewable display area. For each symbol where the special indicator stops, the bonus game awards a bonus game payout for a winning scatter combination formed with that symbol regardless of whether the winning scatter combination is along the pay line. Thus, the symbol where the indicator stops pays as a scatter. In a preferred embodiment, the symbols in the viewable display area are arranged in a rectangular array of rows and columns, and symbols in columns of the array to the right of the special indicator are excluded from (not counted toward) any winning scatter combinations in the bonus game.

BRIEF DESCRIPTION OF THE DRAWINGS

The foregoing and other advantages of the invention will become apparent upon reading the following detailed description and upon reference to the drawings in which.

Figure 1:
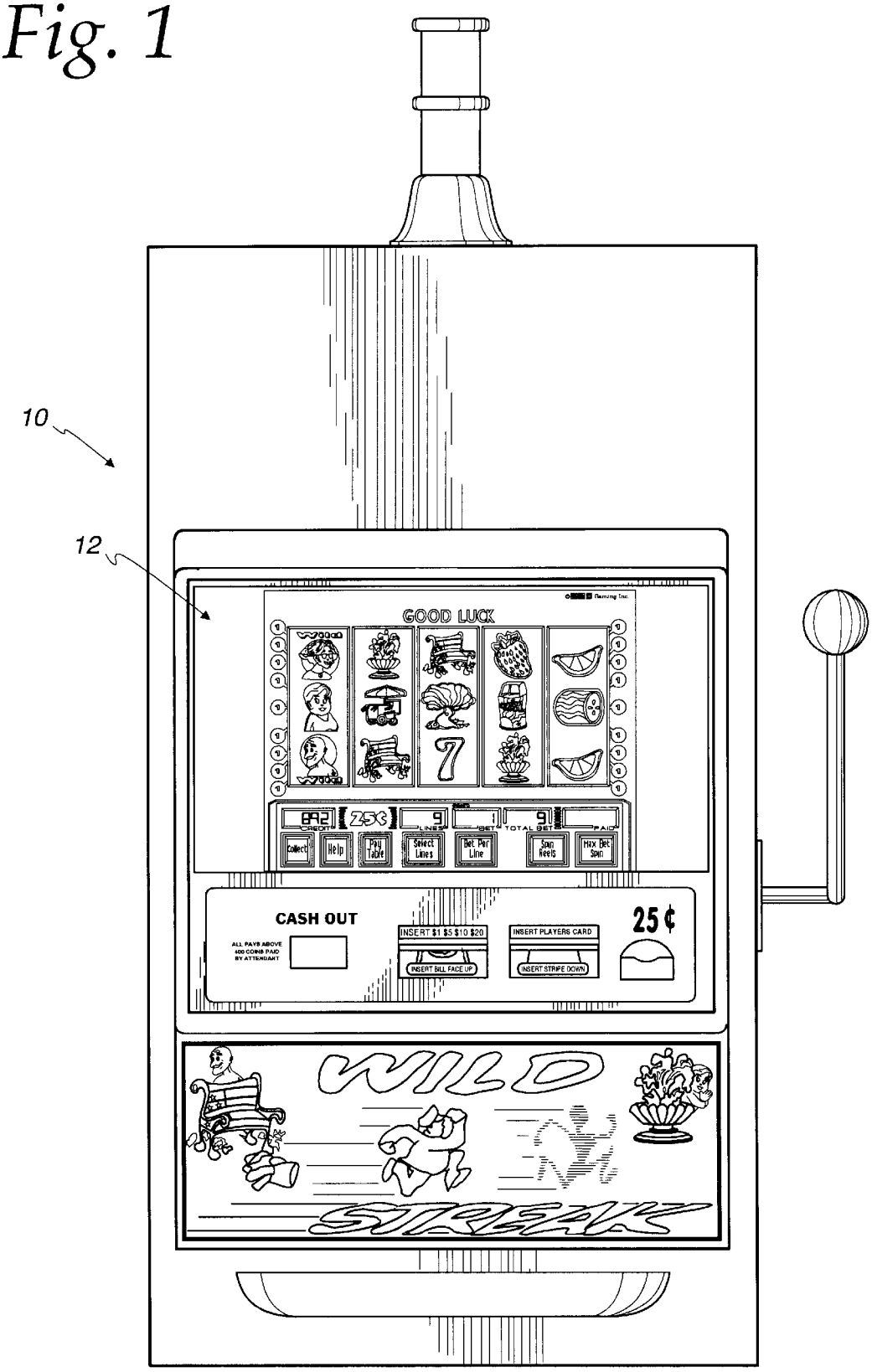
FIG. 1 is a simplified front view of a gaming machine embodying the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Turning now to the drawings and referring initially to FIG. 1, there is depicted a video gaming machine 10 that may be used to implement a bonus game according to the present invention. The gaming machine 10 includes a video display 12 that may comprise a dot matrix, CRT, LED, LCD, electro-luminescent display or generally any type of video display known in the art. In the illustrated embodiment, the gaming machine 10 is an "upright" version in which the video display 12 includes a touch screen and is oriented vertically relative to the player. It will be appreciated, however, that any of several other models of gaming machines are within the scope of the present invention including, for example, a "slant-top" version in which the video display is slanted at about a thirty-degree angle toward the player, or gaming machines that include mechanical rather than video displays.

In one embodiment, the gaming machine 10 is operable to play a game entitled WILD STREAK™ having city park theme symbols. The WILD STREAK™ game features a basic game in the form of a slot machine with five simulated spinning reels (see FIG. 3) and a bonus game with symbols that move around the reels after they have been stopped. It will be appreciated, however, that the gaming machine 10 may be implemented with games other than the WILD STREAK™ game and/or with any of several alternative game themes.

Figure 2:
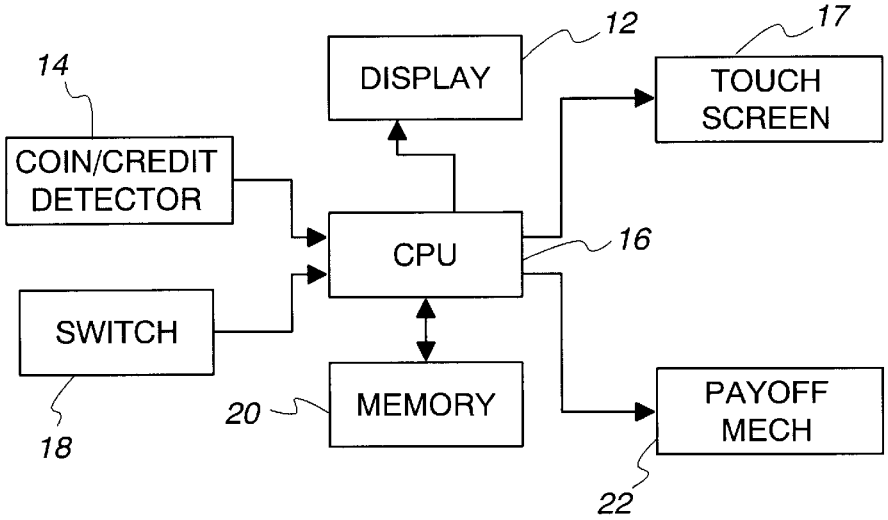
FIG. 2 is a block diagram of a control system suitable for operating the gaming machine.

FIG. 2 is a block diagram of a control system suitable for operating the gaming machine 10. Coin/credit detector 14 signals a CPU 16 when a player has inserted a number of coins or played a number of credits. Then, the CPU 16 operates to execute a game program which causes the video display 12 to display the basic game that includes simulated reels with symbols displayed thereon (see FIG. 3). The player may select the number of pay lines to play and the amount to wager via touch screen input keys 17. The basic game commences in response to the player activating a switch 18 (e.g., by pulling a lever or pushing a button), causing the CPU 16 to set the reels in motion, randomly select a game outcome and then stop the reels to display symbols corresponding to the pre-selected game outcome. In one embodiment, certain of the basic game outcomes cause the CPU 16 to enter a bonus mode causing the video display 12 to show a bonus game. The display screens associated with the WILD STREAK™ bonus game will be described in detail in relation to FIGS. 6 through 12.

A system memory 20 stores control software, operational instructions and data associated with the gaming machine 10. In one embodiment, the memory 20 comprises a separate read-only memory (ROM) and battery-backed random-access memory (RAM). However, it will be appreciated that the system memory 20 may be implemented on any of several alternative types of memory structures or may be implemented on a single memory structure. A payoff mechanism 22 is operable in response to instructions from the CPU 16 to award a payoff of coins or credits to the player in response to certain winning outcomes which might occur in the basic game or bonus game. The payoff amounts corresponding to certain combinations of symbols in the basic game is predetermined according to a pay table stored in system memory 20. The payoff amounts corresponding to certain outcomes of the bonus game are also stored in system memory 20.

Figure 3:
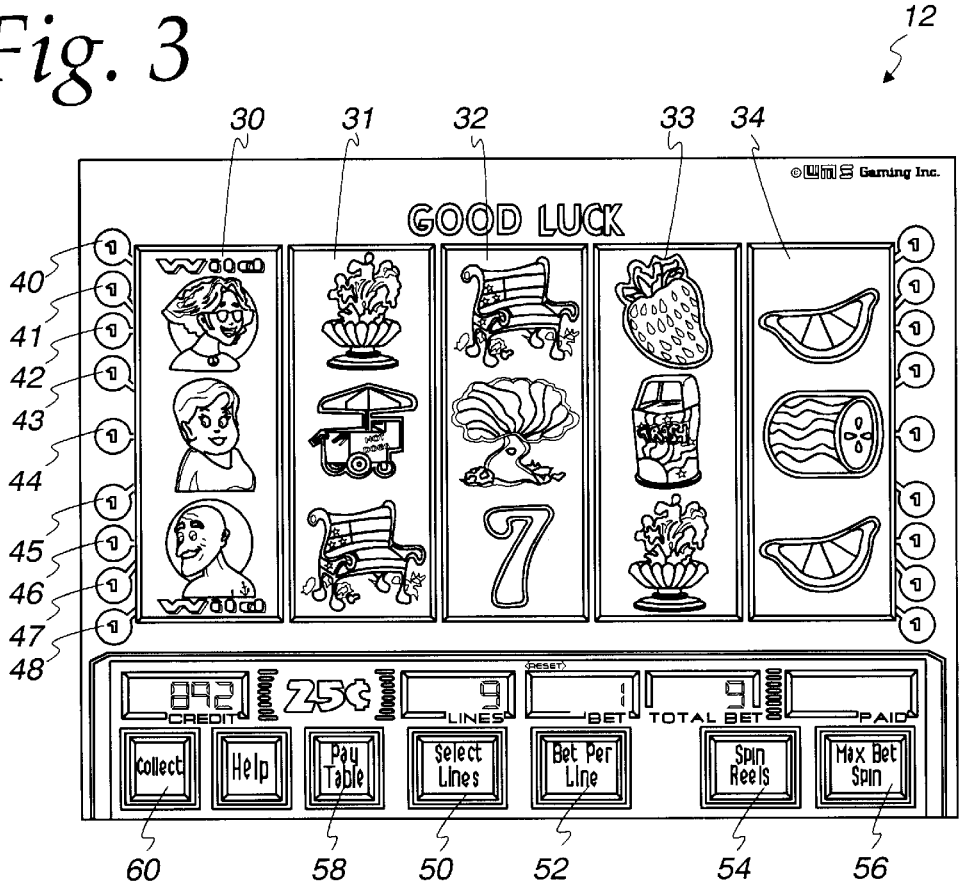
FIG. 3 is a display screen capture associated with a five-reel, nine-line basic game that is played on the gaming machine.

As shown in FIG. 3, the WILD STREAK™ basic game is implemented on the video display 12 on five video simulated spinning reels 30, 31, 32, 33 and 34 (hereinafter "reels") with nine or other number of pay lines 40–48. Each of the pay lines 40–48 extends through one symbol on each of the five reels 30–34. Generally, game play is initiated by inserting a number of coins or playing a number of credits, causing the CPU 16 (FIG. 2) to activate a number of pay lines corresponding to the number of coins or credits played. In one embodiment, the player selects the number of pay lines (between one and nine) to play by pressing a "Select Lines" key 50 on the video display 12. The player then chooses the number of coins or credits to bet on the selected pay lines by pressing the "Bet Per Line" key 52.

After activation of the pay lines, the reels 30–34 may be set in motion by touching the "Spin Reels" key 54 or, if the player wishes to bet the maximum amount per line, by using the "Max Bet Spin" key 56 on the video display 12. Alternatively, other mechanisms such as, for example, a lever or push button may be used to set the reels in motion. The CPU 16 uses a random number generator to select a game outcome (e.g., "basic" game outcome) corresponding to a particular set of reel "stop positions." The CPU 16 then causes each of the video reels 30–34 to stop at the appropriate stop position. Video symbols are displayed on the reels 30–34 to graphically illustrate the reel stop positions and indicate whether the stop positions of the reels represent a winning game outcome. Winning basic game outcomes (e.g., symbol combinations resulting in payment of coins or credits) are identifiable to the player by a pay table. In one embodiment, the pay table is affixed to the machine 10 and/or displayed by the video display 12 in response to a command by the player (e.g., by pressing the "Pay Table" button 58). A winning basic game outcome occurs when the symbols appearing on the reels 30–34 along an active pay line correspond to one of the winning combinations on the pay table. If the displayed symbols stop in a winning combination, the game credits the player an amount corresponding to the award in the pay table for that combination multiplied by the amount of credits bet on the winning pay line. The player may collect the amount of accumulated credits by pressing the "Collect" button 60.

An example of a pay table for the WILD STREAK™ basic and bonus games is shown below:

| WIN COMBINATIONS | | | | | PAY |
|---|---|---|---|---|---|
| Seven | Seven | Seven | Seven | Seven | 5000 |
| Seven | Seven | Seven | Seven | | 500 |
| Seven | Seven | Seven | | | 100 |
| Seven | Seven | | | | 5 |
| Fountain | Fountain | Fountain | Fountain | Fountain | 800 |
| Fountain | Fountain | Fountain | Fountain | | 125 |
| Fountain | Fountain | Fountain | | | 25 |
| Fountain | Fountain | | | | 5 |
| Stand | Stand | Stand | Stand | Stand | 700 |
| Stand | Stand | Stand | Stand | | 100 |
| Stand | Stand | Stand | | | 30 |
| Bench | Bench | Bench | Bench | Bench | 500 |
| Bench | Bench | Bench | Bench | | 80 |
| Bench | Bench | Bench | | | 15 |
| Can | Can | Can | Can | Can | 400 |
| Can | Can | Can | Can | | 70 |
| Can | Can | Can | | | 12 |
| Melon | Melon | Melon | Melon | Melon | 200 |
| Melon | Melon | Melon | Melon | | 60 |
| Melon | Melon | Melon | | | 10 |
| Orange | Orange | Orange | Orange | Orange | 150 |
| Orange | Orange | Orange | Orange | | 30 |
| Orange | Orange | Orange | | | 7 |

-continued

| WIN COMBINATIONS | | | | | PAY |
|---|---|---|---|---|---|
| Strawberry | Strawberry | Strawberry | Strawberry | Strawberry | 100 |
| Strawberry | Strawberry | Strawberry | Strawberry | | 20 |
| Strawberry | Strawberry | Strawberry | | | 7 |
| Tree | Tree | Tree | Tree | Tree | 50 |
| Tree | Tree | Tree | Tree | | 10 |
| Tree | Tree | Tree | | | 2 |

The pay table enables the player to view the winning combinations and their associated payoff amounts. From the pay table it can be seen that the following reel symbols that can lead to a payoff in the basic and bonus games: SEVEN, FOUNTAIN, HOT DOG STAND, BENCH, CAN, MELON, ORANGE, STRAWBERRY, and TREE. In a preferred implementation, the winning combinations start from the first reel 30 (left to right) and span adjacent reels. In an alternative implementation, the winning combinations start from either the first reel 30 (left to right) or the fifth reel 34 (right to left) and span adjacent reels.

Included among the plurality of basic game outcomes are a plurality of different start-bonus outcomes for starting play of a bonus game. A start-bonus outcome may be defined in any number of ways. For example, a start-bonus outcome occurs when a special start-bonus symbol or a special combination of symbols appears on one or more of the reels 30–34 in any predetermined display position. The appearance of a start-bonus outcome causes the processor to shift operation from the basic game to a bonus game.

Figure 4:
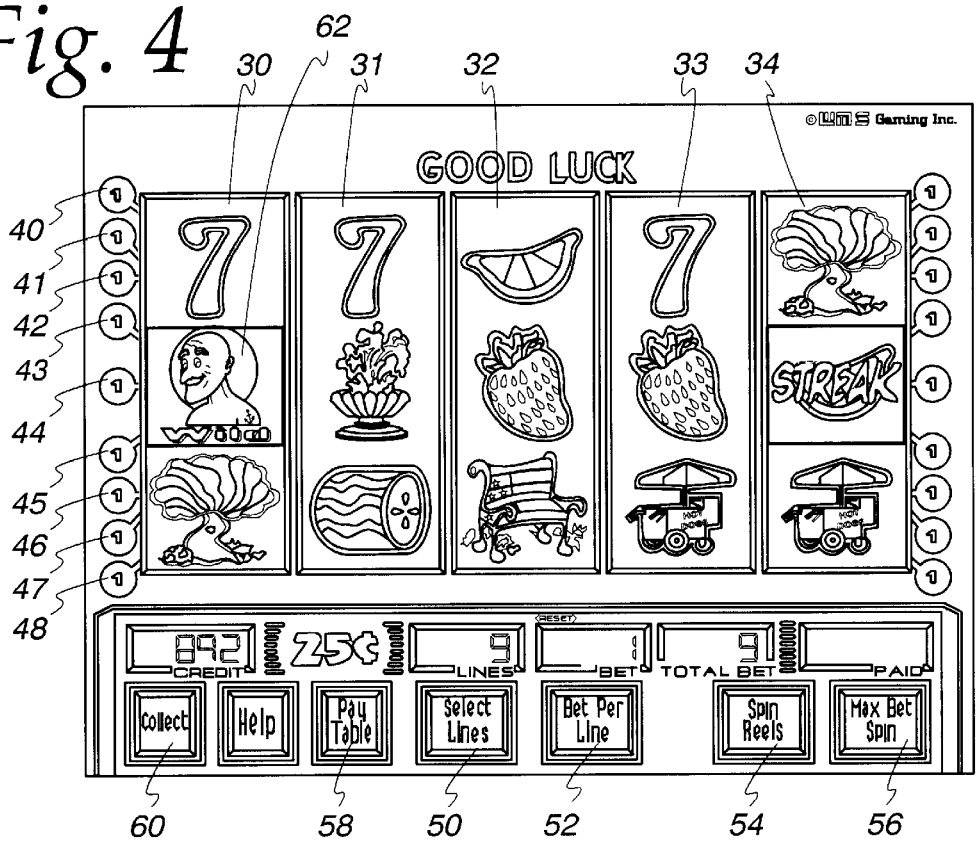
FIG. 4 is a display screen capture showing a start-bonus outcome in the basic game which triggers the bonus game.

The WILD STREAK™ bonus game is triggered by the combination of a primary streaker symbol/character on the first reel 30 and the word "Streak" superimposed over any of the symbols on the fifth reel 34. In one embodiment, there are two primary streaker symbols: OLD MAN STREAKER and YOUNG GUY STREAKER. Therefore, the combination of either of these two primary streaker symbols on the first reel 30 and the word "Streak" superimposed over any of the symbols on the fifth reel 34 triggers the bonus game. FIG. 4 shows an example of a start-bonus outcome in which the OLD MAN STREAKER symbol 62 appears on the first reel 30 and the word "Streak" is superimposed over the ORANGE symbol on the fifth reel 34. In the illustrated embodiment, the OLD MAN STREAKER and YOUNG GUY STREAKER symbols do not appear in the pay table and, therefore, cannot generate a winning basic game outcome. These symbols, however, do provide start-bonus outcomes for triggering the WILD STREAK™ bonus game and, in accordance with a first embodiment, serve as wild symbols when evaluating outcomes of the bonus game.

The reels 30–34 remain stopped throughout the WILD STREAK™ bonus game. However, the primary streaker symbol 62 and a stop-bonus POLICEMAN symbol 64 randomly move around the symbol array formed by the stopped reels 30–34.

Figure 5:
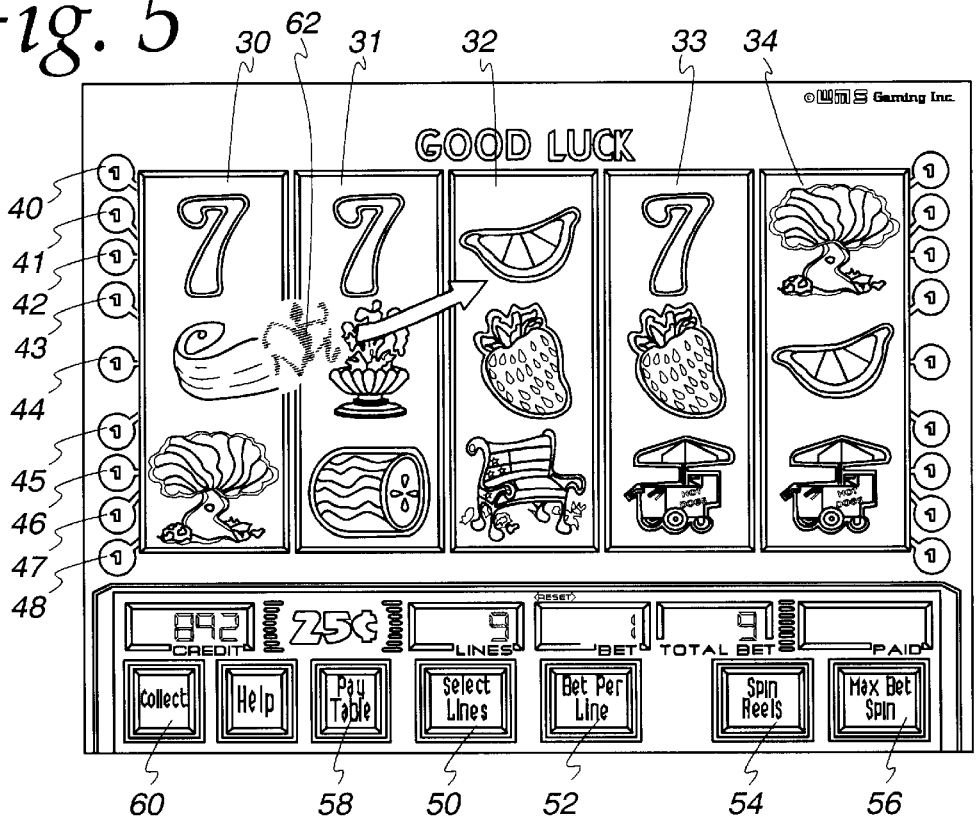
FIGS. 5 through 13 are display screen captures associated with a first embodiment of the bonus game.
Figure 6:
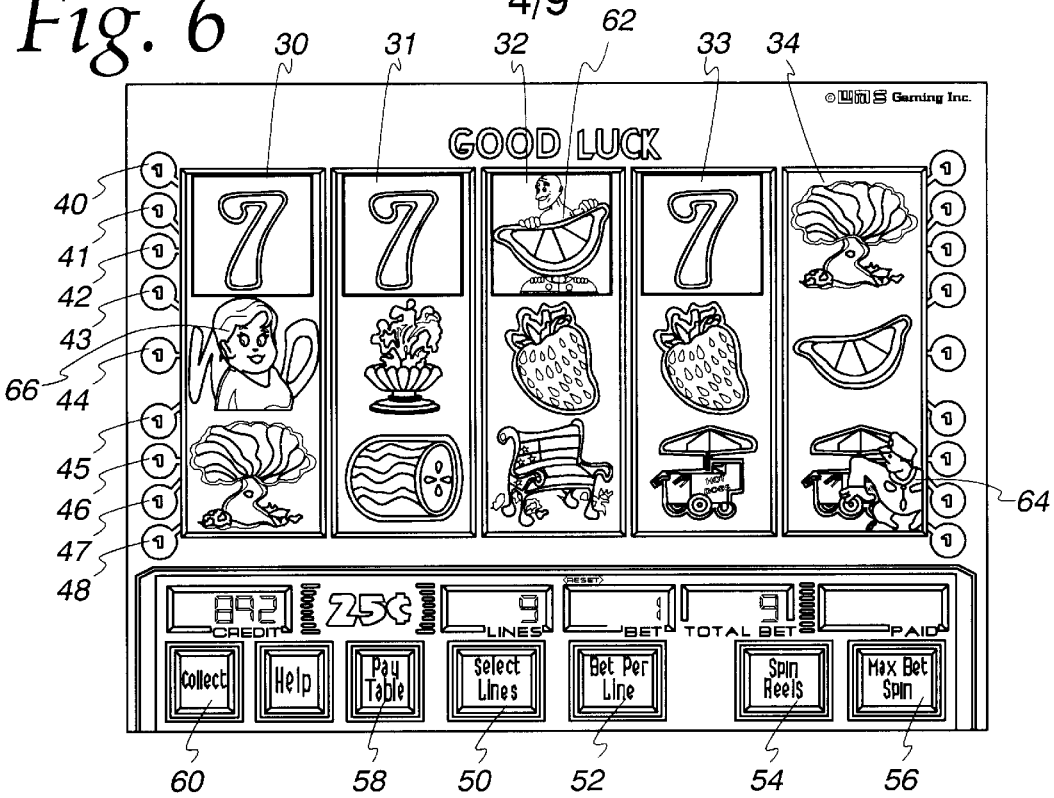
Figure 7:
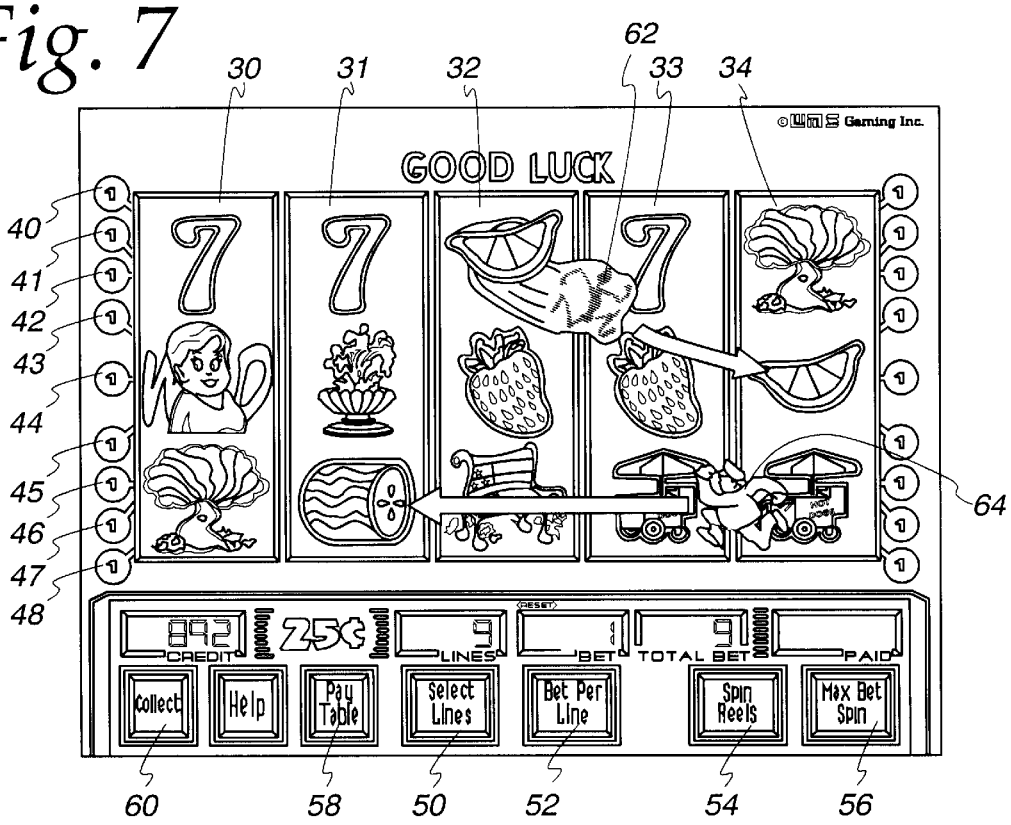
Figure 8:
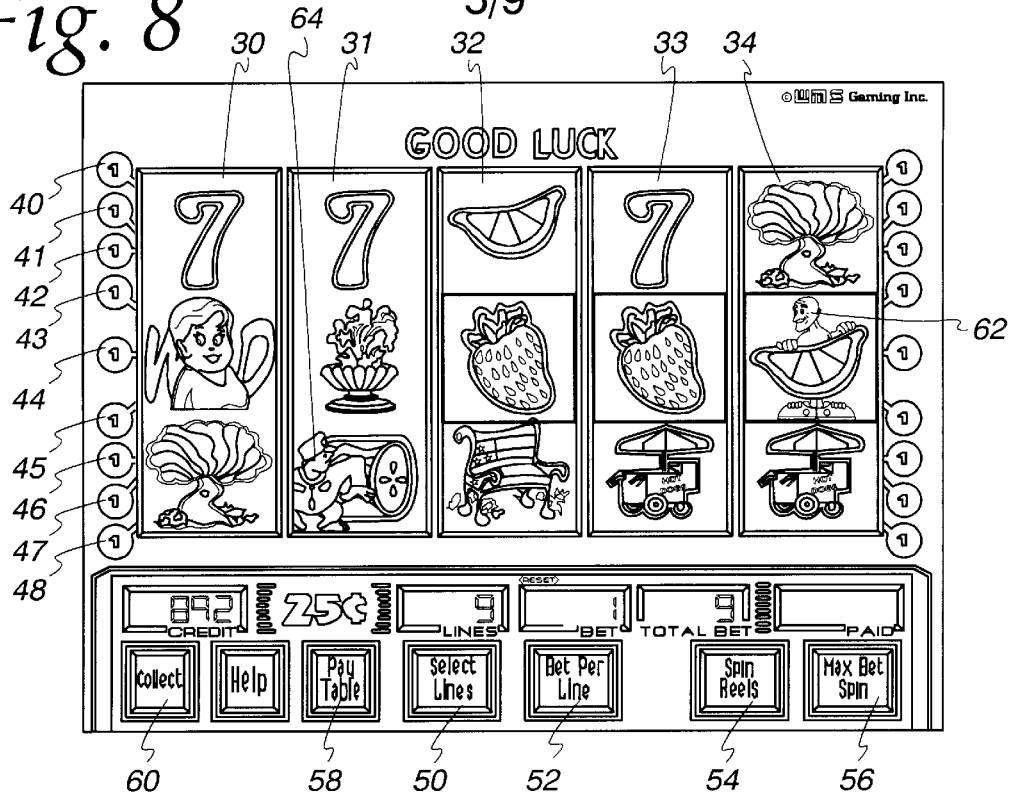
Figure 9:
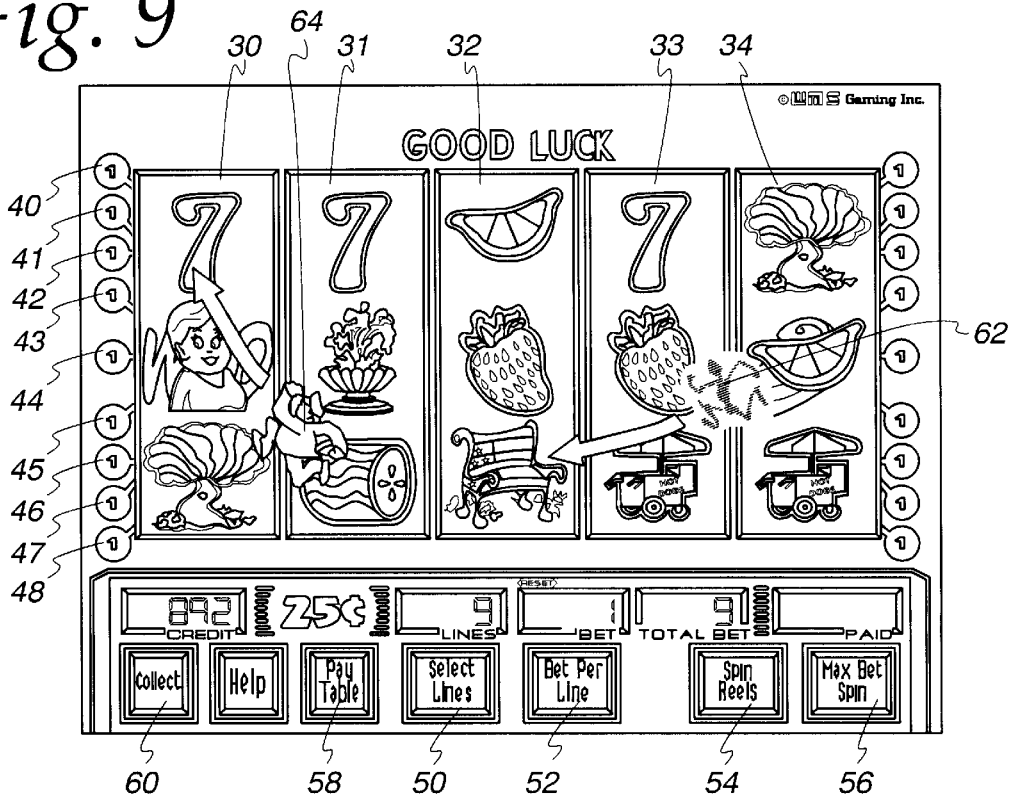
Figure 10:
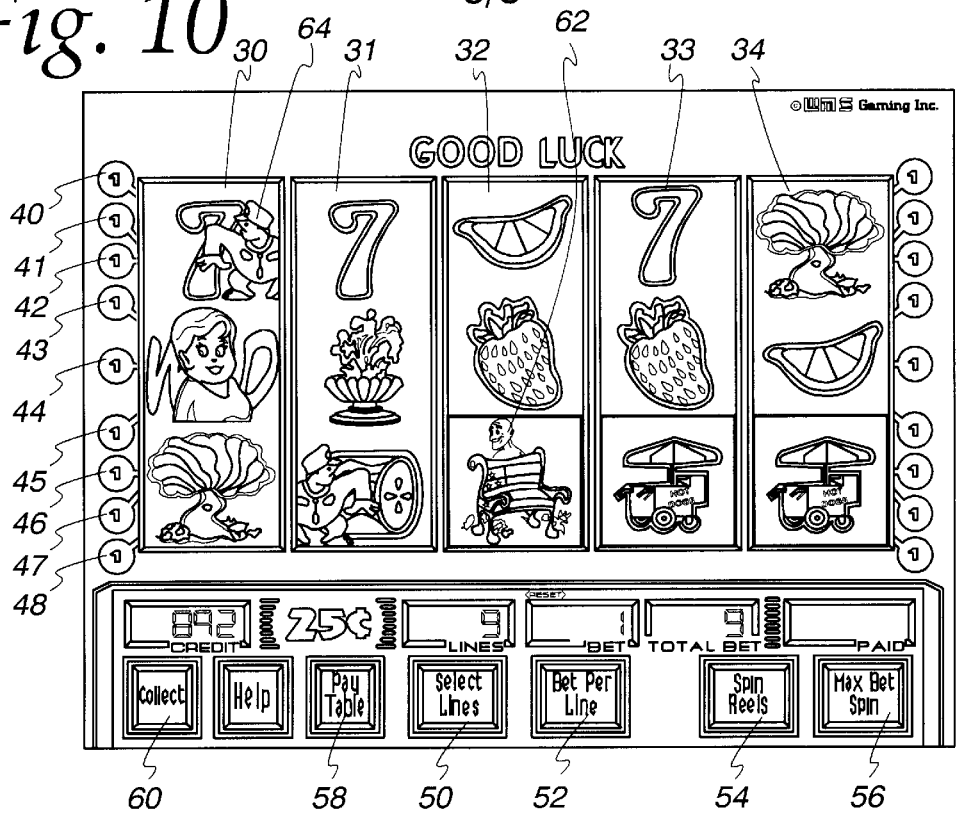
Figure 11:
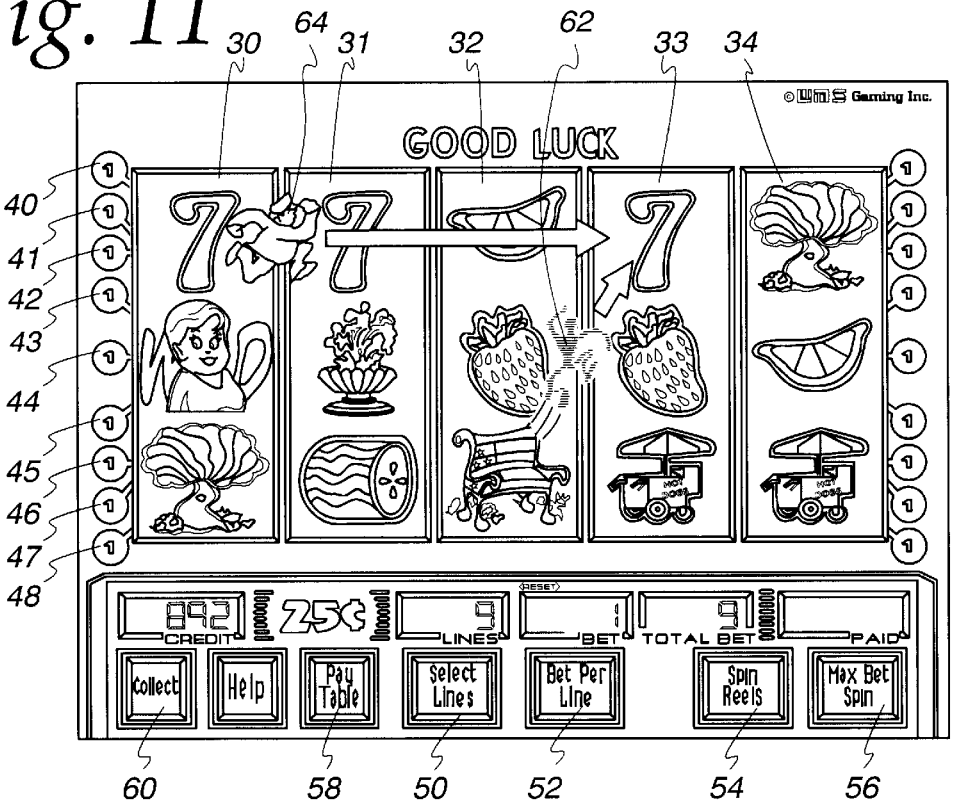

In accordance with a first embodiment of the bonus game, during a first bonus round shown in FIGS. 5 and 6, the primary streaker symbol 62 moves or "runs" from its original position on the first reel 30 to a new position on the symbol array. The streaker stops at this new position and hides behind the reel symbol (e.g., ORANGE symbol) already present at that position. The CPU then evaluates the symbol array for any winning combinations along an active pay line that contain the primary streaker symbol 62 in the combination. The array position containing the primary streaker symbol 62 and the original position of the streaker symbol on the reel 30 serve as wilds during this evaluation. The winning combinations for the bonus game are defined by the pay table above or, alternatively, by a different pay table applicable only to the bonus game. In the example shown in FIG. 6, the primary streaker symbol 62 generates the winning combination SEVEN, SEVEN, SEVEN, SEVEN along the pay line 42, where the third SEVEN results from the ORANGE symbol being evaluated as a wild due to the primary streaker symbol 62. According to the pay table, this winning combination generates a bonus game payout of 500 coins multiplied by the line bet if the pay line 42 is active.

After the first bonus round, the stop-bonus POLICEMAN symbol 64 appears in one of the symbol positions of the fifth reel 34 as shown in FIG. 6. The POLICEMAN symbol 64 always avoids the primary streaker symbol 62 when first appearing on the symbol array.

During each subsequent bonus round, the CPU randomly selects a destination position for the primary streaker symbol 62 and then randomly selects a destination position for POLICEMAN symbol 64 from among the remaining array positions. The streaker stops at its destination position and hides behind the reel symbol already present at that position. The CPU then evaluates the symbol array for any winning combinations along an active pay line that contain the primary streaker symbol 62 in the combination. The array position containing the primary streaker symbol 62 and the original position of the streaker symbol on the reel 30 serve as wilds during this evaluation. In the example shown in FIGS. 7 and 8, the primary streaker symbol 62 generates the winning combination STRAWBERRY, STRAWBERRY, STRAWBERRY along the pay line 44, where the third STRAWBERRY results from the ORANGE symbol being evaluated as a wild due to the primary streaker symbol 62. According to the pay table, this winning combination generates a bonus game payout of 7 coins multiplied by the line bet if the pay line 44 is active. In the example shown in FIGS. 9 and 10, the primary streaker symbol 62 generates the winning combination HOT DOG STAND, HOT DOG STAND, HOT DOG STAND along the pay line 46, where the first HOT DOG STAND results from the BENCH symbol being evaluated as a wild due to the primary streaker symbol 62. According to the pay table, this winning combination generates a bonus game payout of 30 coins multiplied by the line bet if the pay line 46 is active.

The bonus game ends when the number of bonus rounds reaches a predetermined count, at which time the CPU selects the destination position for the POLICEMAN symbol 64 to be the same as the destination position of the primary streaker symbol 62 (i.e., the POLICEMAN symbol catches the streaker symbol). In the example shown in FIG. 11, both the primary steaker symbol 62 and the POLICEMAN symbol 64 are moving to the upper position of the fourth reel 33.

Referring back to FIG. 6, a secondary streaker symbol 66 optionally accompanies the primary streaker symbol 62. The secondary streaker symbol 66 appears on the reel 30 where the primary streaker symbol 62 originally started. Generally, the secondary streaker symbol 66 remains in this original position as a bystander as the primary streaker symbol 62 and the POLICEMAN symbol 64 "streak" around the symbol array.

Figure 12:
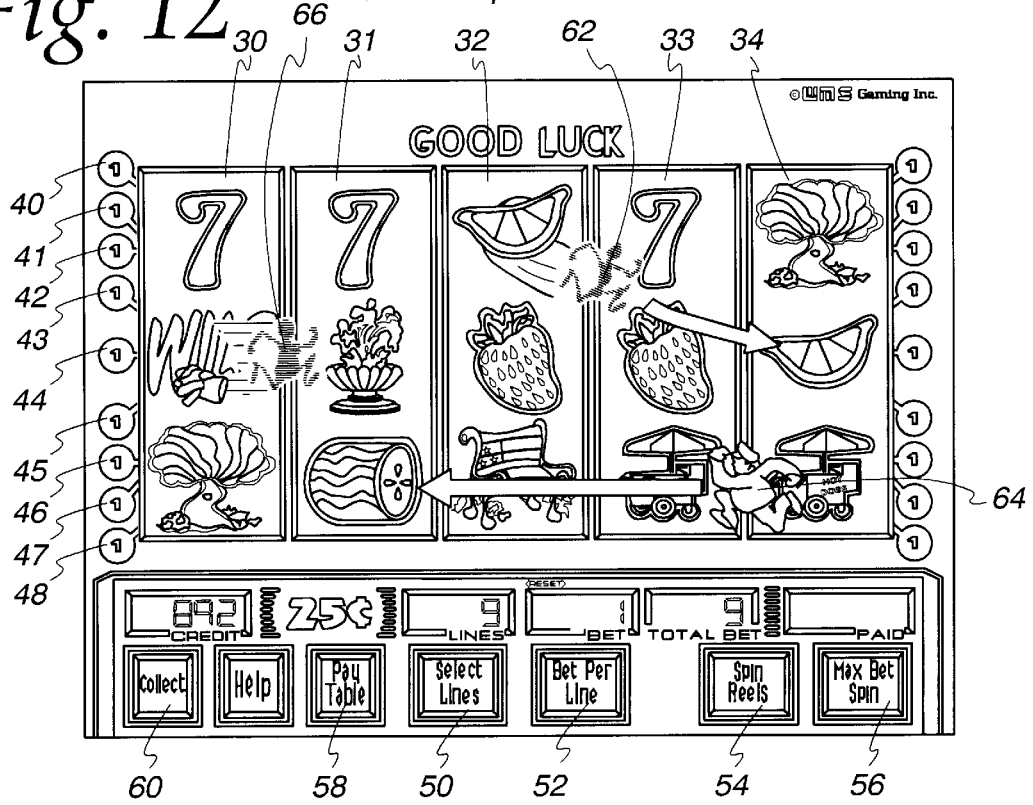
Figure 13:
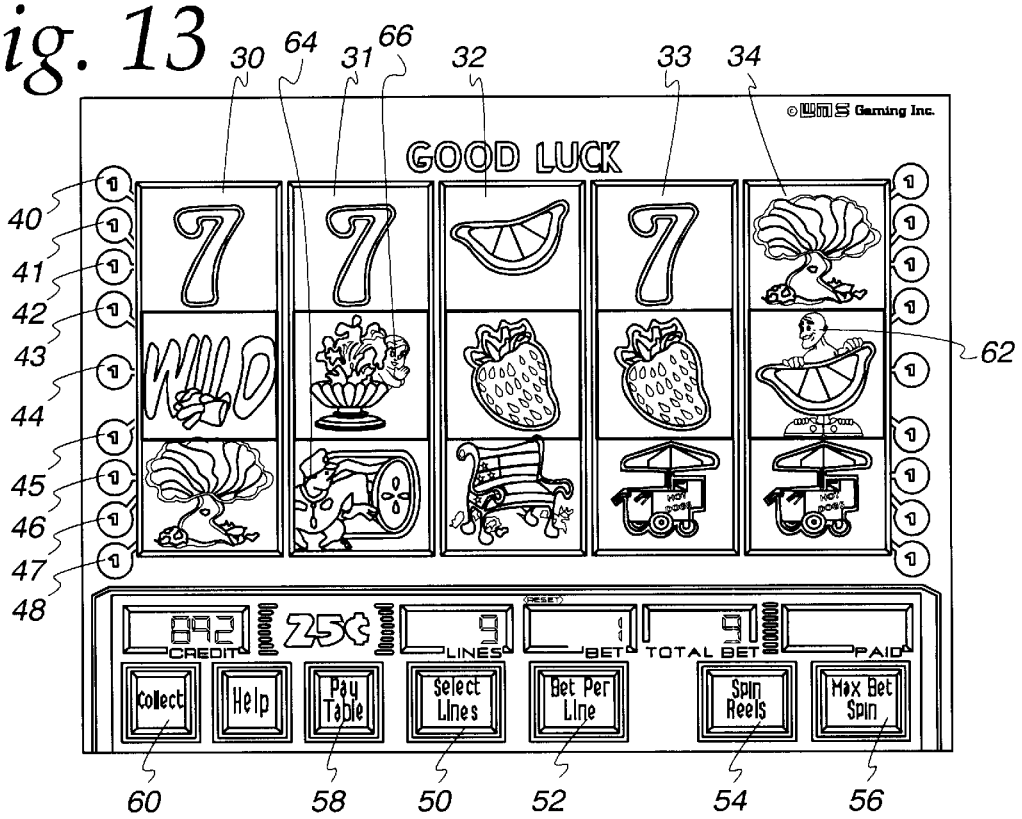

On some bonus rounds, however, the secondary streaker symbol 66 may remove her clothes and join the primary streaker symbol 62 in "streaking" around the symbol array. The pile of clothes is left in here place. This "double streaking" situation is shown in FIGS. 12 and 13. The two streakers stop at their new positions and hide behind the reel symbols already present at those positions. The CPU then evaluates the symbol array for any winning combinations along an active pay line that contain either streaker 62 or 66 in the combination. The two array positions containing the respective primary and secondary streaker symbols 62 and 66, as well as the original position of the streaker symbols on the reel 30, serve as wilds during this evaluation, resulting in a total of three wilds. In the example shown in FIG. 13, the primary and secondary streaker symbols 62 and 66 generate the winning combination STRAWBERRY, STRAWBERRY, STRAWBERRY, STRAWBERRY, and STRAWBERRY along the pay line 44, where (a) the first STRAWBERRY results from the wild symbol on the first reel 30, (b) the second STRAWBERRY results from the FOUNTAIN symbol being evaluated as a wild due to the secondary streaker symbol 66, and (c) the fifth STRAWBERRY results from the ORANGE symbol being evaluated as a wild due to the primary streaker symbol 62. According to the pay table, this winning combination generates a bonus game payout of 100 coins multiplied by the line bet if the pay line 44 is active. The bonus game ends when either the primary streaker symbol 62 or the secondary streaker symbol 66 is "caught" by the POLICEMAN symbol 64.

In accordance with a second embodiment of the bonus game, only the original starting position of the streaker symbol on the reel 30 serves as a wild when evaluating the symbol array during each bonus round. In addition, the CPU evaluates the symbol array for any winning combinations formed with the symbol where the streaker stops regardless of whether the winning symbol combination is along an active pay line. Thus, the symbol where the streaker stops pays as a scatter. In a preferred implementation of this second embodiment of the bonus game, the symbols on reels to the right of the streaker are excluded from (not counted toward) any winning combinations. The winning combinations for the bonus game are defined by the pay table above or, alternatively, by a different pay table applicable only to the bonus game. Preferably, only the highest paying winning combination formed with the symbol where the streaker stops is paid during a round of the bonus game.

Figure 14:
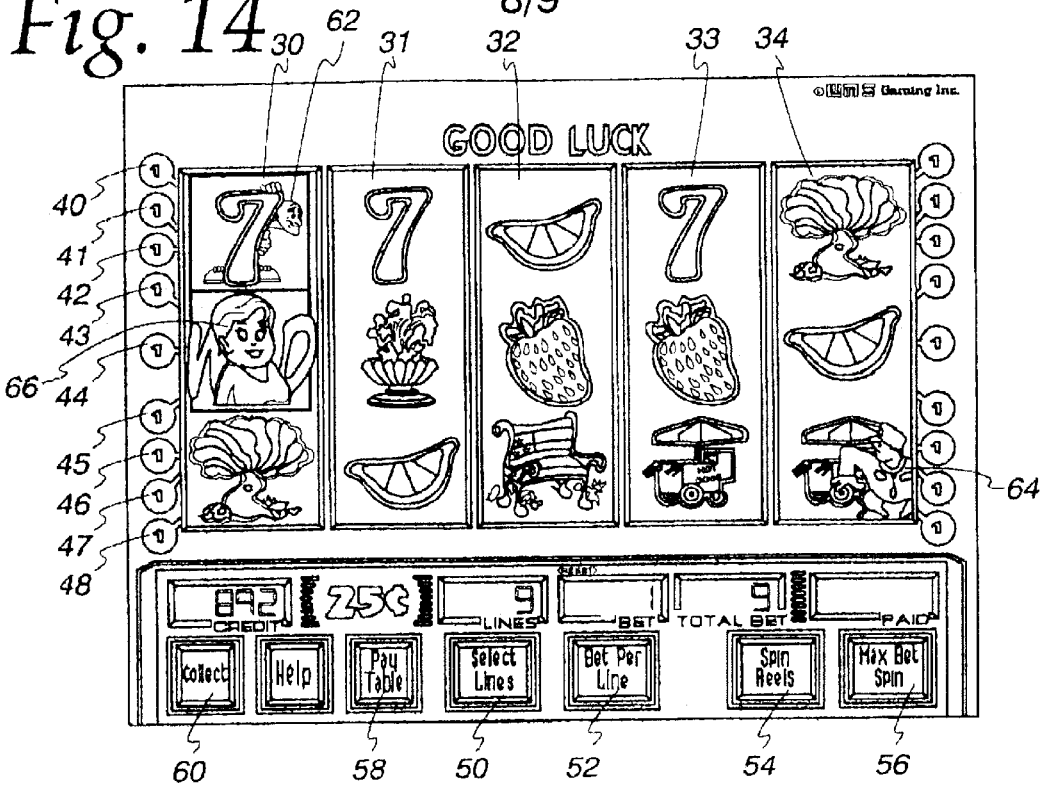
FIGS. 14 through 16 are display screen captures associated with a second embodiment of the bonus game.

In the example shown in FIG. 14, the primary streaker symbol 62 stops on the SEVEN in the top row of reel 30. Therefore, the CPU evaluates the symbol array for any winning combinations formed with the SEVEN regardless of whether the winning combination is along an active pay line. If, in accordance with the preferred implementation, symbols on reels to the right of the primary streaker 62 are excluded from this evaluation, then the winning scatter combination is SEVEN, SEVEN. This winning combination is formed by the SEVEN in the top row of reel 30 and the wild in the middle row of reel 30. The middle row of reel 30 is wild because this was the original position of the primary streaker symbol 62. According to the pay table, the winning combination of SEVEN, SEVEN generates a bonus game payout of 5 coins multiplied by the total bet. If, on the other hand, symbols on reels to the right of the primary streaker 62 are included in the evaluation, then the winning scatter combination would be SEVEN, SEVEN, SEVEN, SEVEN due to the two additional SEVEN symbols on respective reels 31 and 33. According to the pay table, this winning combination produces a payout of 500 coins multiplied by the total bet.

Figure 15:
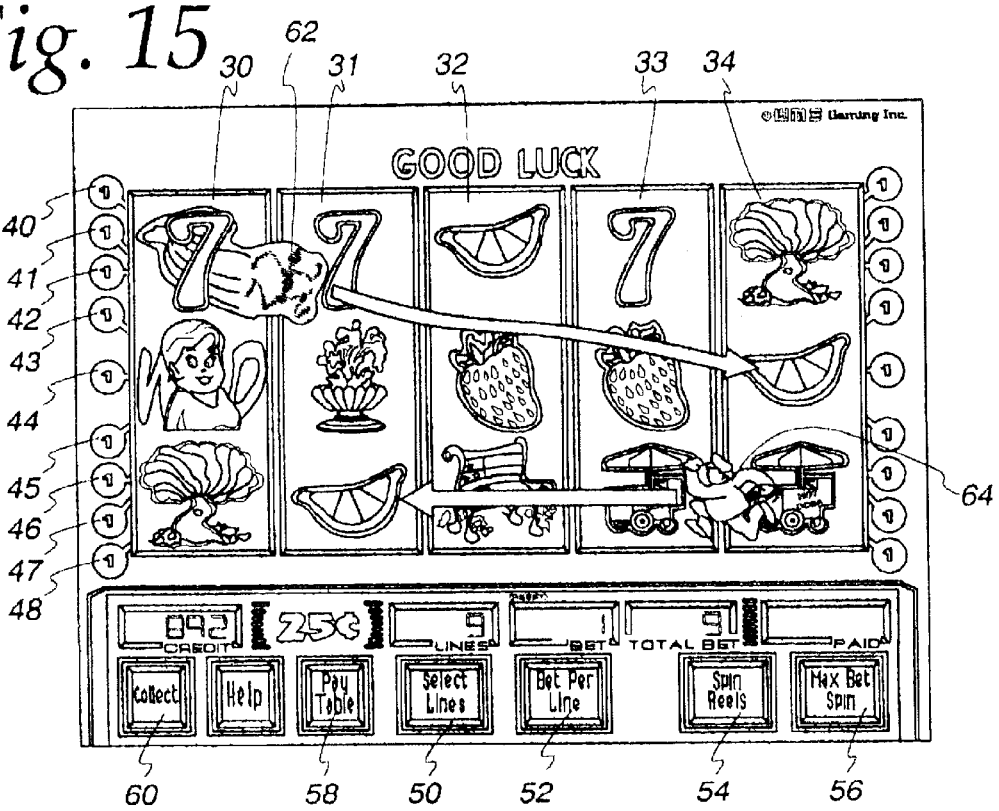
Figure 16:
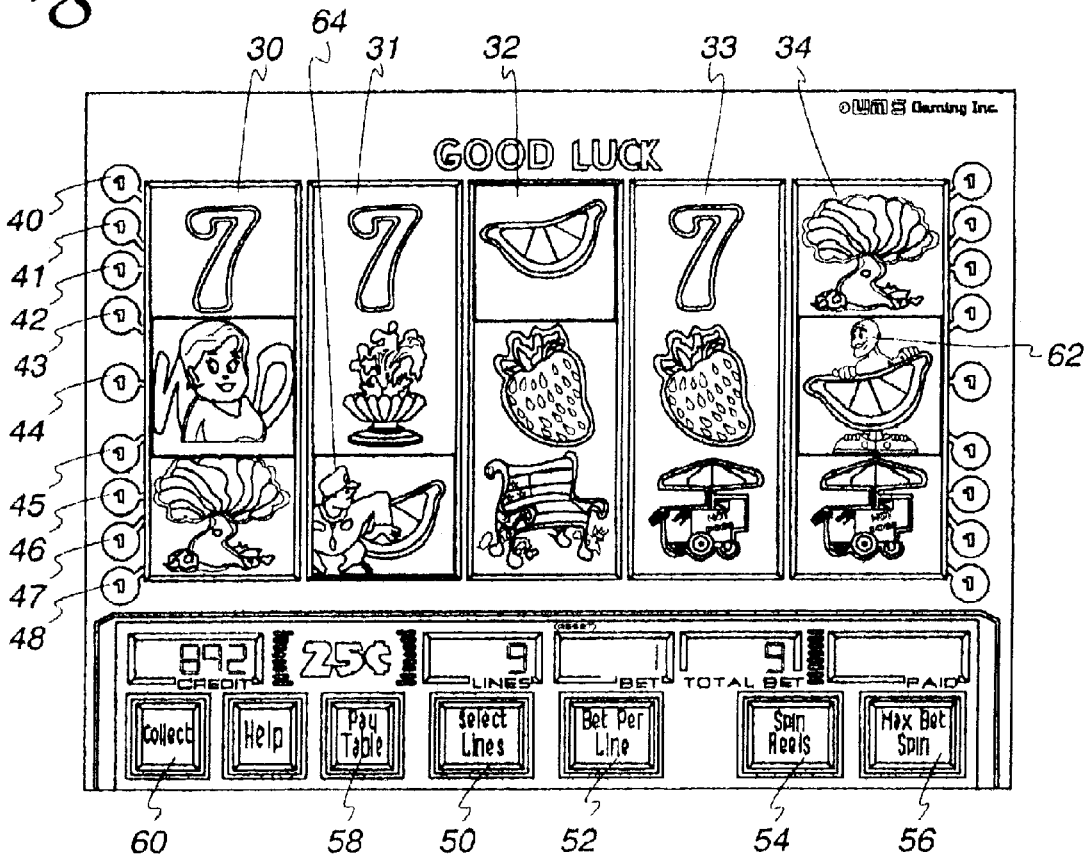

In another example shown in FIGS. 15 and 16, the primary streaker 62 moves to (see FIG. 15) and stops on the ORANGE in the middle row of reel 34 without encountering the policeman 64. The CPU evaluates the symbol array for the highest paying winning combination formed with the ORANGE regardless of whether the winning combination is along an active pay line. In this case, the winning combination is ORANGE, ORANGE, ORANGE, ORANGE formed by the wild in the middle row of reel 30, the ORANGE in the bottom row of reel 31, the ORANGE in the top row of reel 32, and the ORANGE in the middle row of reel 34. According to the pay table, the winning combination of ORANGE, ORANGE, ORANGE, ORANGE generates a bonus game payout of 30 coins multiplied by the total bet. As stated above, only the highest paying winning combination is preferably paid out to the player during a round of the bonus game. Therefore, the winning combination of ORANGE, ORANGE, ORANGE, which generates a lesser payout of 7 coins multiplied by the total bet, is preferably not paid out. Whether or not symbols on reels to the right of the primary streaker 62 are included in the evaluation does not matter in the example in FIGS. 15 and 16 because the primary streaker 62 is already on the rightmost reel 34.

In this second embodiment of the bonus game, the secondary streaker symbol 66 (see FIG. 14) is optionally employed and sometimes joins the primary streaker 62 in "streaking" around the symbol array. Like the primary streaker 62, the symbol where the secondary streaker 66 stops during each bonus round pays as a scatter so that the player is awarded for (1) the highest paying winning combination formed with the symbol where the primary streaker 62 stops and (2) the highest paying winning combination formed with the symbol where the secondary streaker 66 stops. If the primary and secondary streakers 62 and 66 stop on the same symbol, the player is awarded twice for the highest paying winning combination formed with that symbol. In one implementation, the primary and secondary streakers 62 and 66 never stop on the same symbol.

While the present invention has been described with reference to one or more particular embodiments, those skilled in the art will recognize that many changes may be made thereto without departing from the spirit and scope of the present invention. For example, the basic game need not comprise a spinning reel slot machine game as illustrated in FIG. 1, but may comprise virtually any type of game of chance or skill or combination of games having outcomes (e.g., start-bonus outcomes) that trigger play of a bonus game on the video display 12. For example, the basic game may comprise a video poker or video blackjack game. The basic game may itself be implemented on the video display 12 or a separate video display. In embodiments where both the basic and bonus games are implemented in video, each game may be shown on the same video display 12. In an alternative embodiment, the WILD STREAK™ bonus game may be implemented as a stand-alone basic game that is not triggered by a start-bonus outcome on spinning reels. Each of these embodiments and obvious variations thereof is contemplated as falling within the spirit and scope of the claimed invention, which is set forth in the following claims.

What is claimed is:

1. A gaming machine controlled by a processor in response to a wager, comprising:

a basic game including a plurality of symbols randomly placed in a viewable display area relative to at least one pay line, the basic game awarding a basic game payout for any winning symbol combinations along the pay line, the basic game including a start-bonus outcome; and a bonus game triggered by the start-bonus outcome, the bonus game including a special indicator progressively moved to and stopped at one or more of the symbols in the viewable display area;

wherein for each symbol where the special indicator stops, the bonus game awards a bonus game payout for a winning scatter combination formed with the symbol regardless of whether the winning scatter combination is along the pay line; and wherein the symbols in the viewable display area are arranged in a rectangular array of rows and columns, and the winning scatter combination in the bonus game excludes symbols in the columns of the array to the right of the special indicator.

2. A gaming machine controlled by a processor in response to a wager, comprising:

a basic game including a plurality of symbols randomly placed in a viewable display area relative to at least one pay line, the basic game awarding a basic game payout for any winning symbol combinations along the pay line, the basic game including a start-bonus outcome; and a bonus game triggered by the start-bonus outcome, the bonus game including a special indicator progressively moved to and stopped at one or more of the symbols in the viewable display area;

wherein for each symbol where the special indicator stops, the bonus game awards a bonus game payout for a winning scatter combination formed with the symbol regardless of whether the winning scatter combination is along the pay line; and wherein if multiple winning scatter combinations are formed with the symbol where the special indicator stops, the bonus game only awards the bonus game payout for a highest paying one of the winning scatter combinations.

3. A gaming machine controlled by a processor in response to a wager, comprising:

a basic game including a plurality of symbols randomly placed in a viewable display area relative to at least one pay line, the basic game awarding a basic game payout for any winning symbol combinations along the pay line, the basic game including a start-bonus outcome; and a bonus game triggered by the start-bonus outcome, the bonus game including a special indicator progressively moved to and stopped at one or more of the symbols in the viewable display area;

wherein for each symbol where the special indicator stops, the bonus game awards a bonus game payout for a winning scatter combination formed with the symbol regardless of whether the winning scatter combination is along the pay line; and wherein an original starting position of the special indicator in the viewable display area is a wild symbol.

4. A gaming machine controlled by a processor in response to a wager, comprising:

a plurality of symbols randomly placed in a viewable display area relative to at least one pay line, a basic payout being awarded for any winning symbol combinations along the pay line; and a special indicator progressively moved to and stopped at one or more of the symbols in the viewable display area, wherein for each symbol where the special indicator stops, a bonus payout is awarded for a winning scatter combination formed with the symbol regardless of whether the winning scatter combination is along the pay line; and wherein the symbols in the viewable display area are arranged in a rectangular array of rows and columns, and the winning scatter combination excludes symbols in the columns of the array to the right of the special indicator.

5. A gaming machine controlled by a processor in response to a wager, comprising:

a plurality of symbols randomly placed in a viewable display area relative to at least one pay line, a basic payout being awarded for any winning symbol combinations along the pay line; and a special indicator progressively moved to and stopped at one or more of the symbols in the viewable display area, wherein for each symbol where the special indicator stops, a bonus payout is awarded for a winning scatter combination formed with the symbol regardless of whether the winning scatter combination is along the pay line; and wherein if multiple winning scatter combinations are formed with the symbol where the special indicator stops, the bonus game payout is awarded for only a highest paying one of the winning scatter combinations.

6. A gaming machine controlled by a processor in response to a wager, comprising:

a plurality of symbols randomly placed in a viewable display area relative to at least one pay line, a basic payout being awarded for any winning symbol combinations along the pay line; and a special indicator progressively moved to and stopped at one or more of the symbols in the viewable display area, wherein for each symbol where the special indicator stops, a bonus payout is awarded for a winning scatter combination formed with the symbol regardless of whether the winning scatter combination is along the pay line; and wherein an original starting position of the special indicator in the viewable display area is a wild symbol.

* * * * *